US007740507B2

(12) United States Patent
Stanhope

(10) Patent No.: US 7,740,507 B2
(45) Date of Patent: Jun. 22, 2010

(54) COUPLING FOR SOLENOID AND LEAD FRAME

(75) Inventor: Dan Stanhope, Whitehall, MI (US)

(73) Assignee: Acutex, Inc., Whitehall, MI (US)

( * ) Notice: Subject to any disclaimer, the term of this patent is extended or adjusted under 35 U.S.C. 154(b) by 0 days.

(21) Appl. No.: 12/390,572

(22) Filed: Feb. 23, 2009

(65) Prior Publication Data

US 2009/0212888 A1 Aug. 27, 2009

Related U.S. Application Data

(60) Provisional application No. 61/030,682, filed on Feb. 22, 2008.

(51) Int. Cl.
*H01R 33/76* (2006.01)

(52) U.S. Cl. ..... 439/683

(58) Field of Classification Search ..... 439/683, 439/684, 685, 688, 130, 225
See application file for complete search history.

(56) References Cited

U.S. PATENT DOCUMENTS 5,263,881 A * 11/1993 Henrici et al. ..... 439/686
5,845,672 A * 12/1998 Reuter et al. ..... 137/315.03
7,214,103 B2 * 5/2007 Kim et al. ..... 439/680

* cited by examiner

*Primary Examiner*—Phuong K Dinh
(74) *Attorney, Agent, or Firm*—Haynes and Boone, LLP

(57) ABSTRACT

A coupling for a solenoid and a lead frame includes plurality of terminals. Each terminal includes a plurality of terminal guides. A lead frame defines a plurality of slots. A plurality of locating and support channels are defined adjacent each slot, wherein each of the plurality of terminals are coupled to a respective slot on the lead frame, and the plurality of terminal guides on each terminal are located in the plurality of locating and support channels defined adjacent a respective slot.

11 Claims, 3 Drawing Sheets

COUPLING FOR SOLENOID AND LEAD FRAME

CROSS REFERENCE TO RELATED APPLICATIONS

The present application is related to U.S. Provisional Application No. 61/030,682, filed on Feb. 22, 2008, the disclosures of which are incorporated herein by reference.

BACKGROUND

The present disclosure relates generally to solenoid couplings, and more particularly to a coupling for a solenoid and a lead frame.

Conventional electrical connections for a solenoid have used a direct plug-in or bayonet-type connection. Conventional solenoids sometimes fail to maintain in proper connection and alignment due to vibrations and other forces that cause the solenoid to be decoupled from the lead frame.

Accordingly, it would be desirable to provide an improved coupling for a solenoid and lead frame.

SUMMARY

According to one embodiment, a coupling for a solenoid and a lead frame includes plurality of terminals, each terminal including a plurality of terminal guides, a lead frame defining a plurality of slots, and a plurality of locating and support channels defined adjacent each slot, wherein each of the plurality of terminals are coupled to a respective slot on the lead frame, and the plurality of terminal guides on each terminal are located in the plurality of locating and support channels defined adjacent a respective slot.

DETAILED DESCRIPTION

Figure 1A:
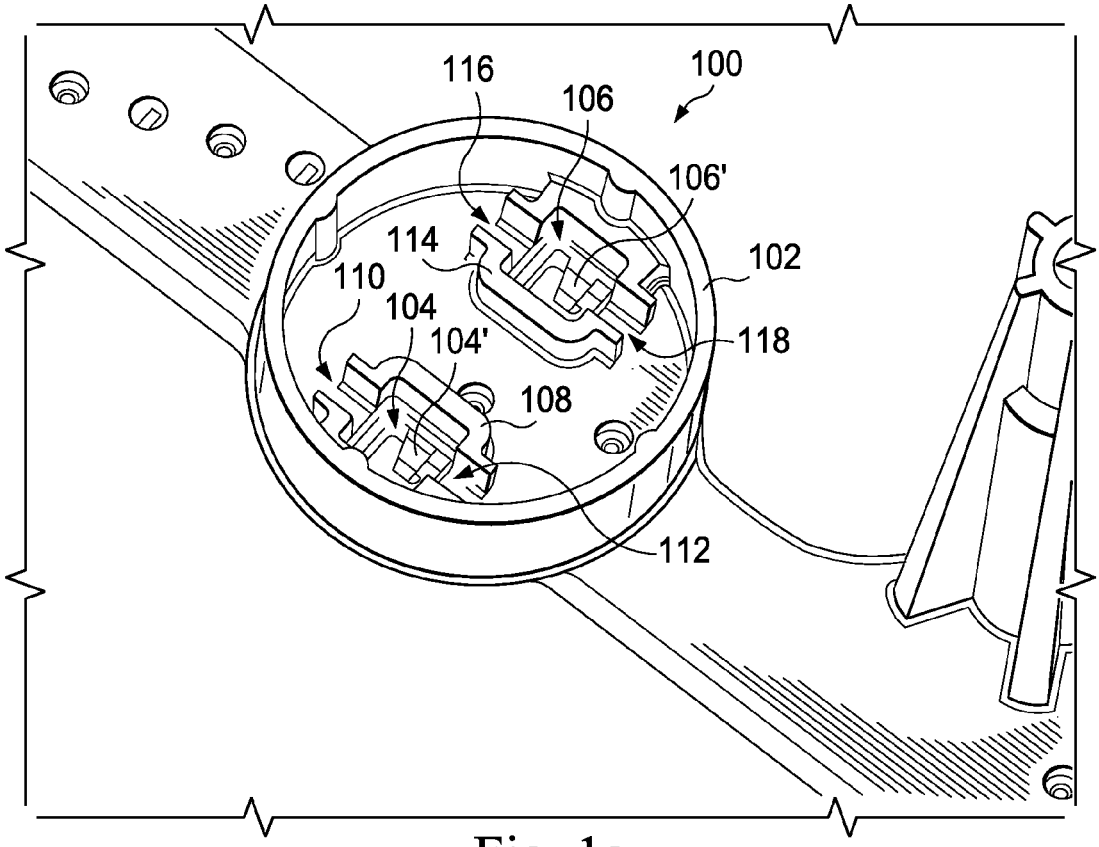
FIG. 1*a* is a perspective view illustrating an embodiment of a lead frame.
Figure 1B:
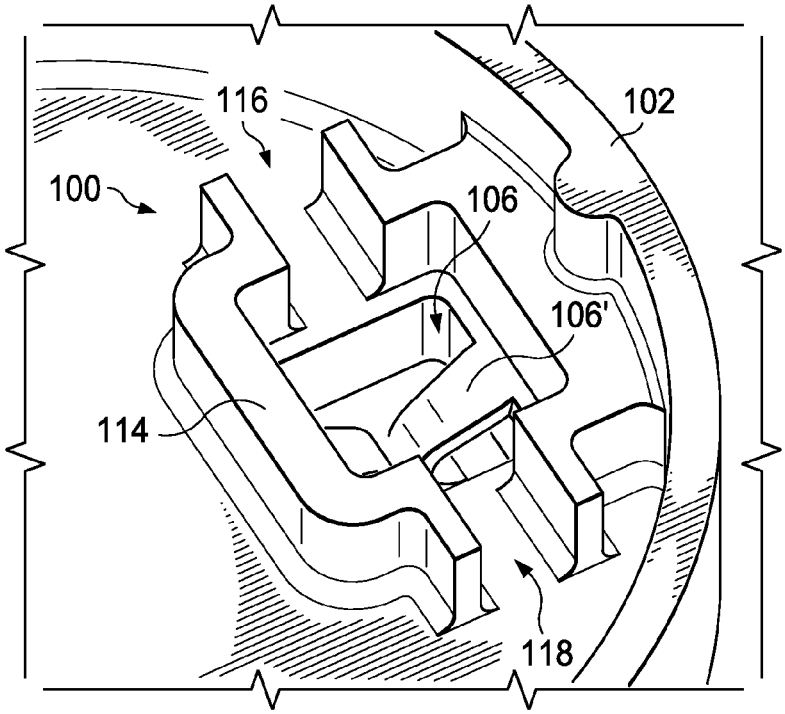
FIG. 1*b* is a perspective view illustrating an embodiment of the lead frame of FIG. 1*a*.

Referring now to FIGS. 1*a* and 1*b*, a lead frame 100 is illustrated. The lead frame 100 includes a circular base 102 defining a pair of slots 104 and 106 located in a spaced apart orientation on opposite sides of the base 102. In an embodiment, the slots 104 and 106 include electrically conductive members 104', 106' operable to provide an electrical connection to circuitry (not illustrated for clarity) within the lead frame 100. A locating and support member 108 is located adjacent the slot 104 and defines a pair of locating and support channels 110 and 112 that are located in a substantially co-linear orientation on opposite sides of the slot 104. A locating and support member 114 is located adjacent the slot 106 and defines a pair of locating and support channels 116 and 118 that are located in a substantially co-linear orientation on opposite sides of the slot 106. In the illustrated embodiment, the locating and support channels 116 and 118 are co-linear along a line that is parallel to and spaced apart from the line along which the locating and support channels 110 and 112 are co-linear.

Figure 2A:
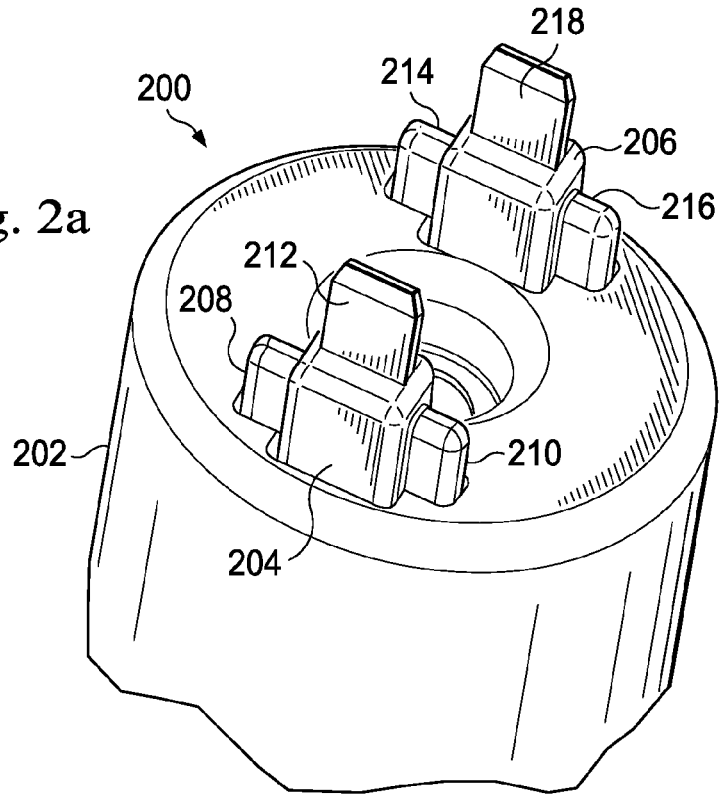
FIG. 2*a* is a perspective view illustrating an embodiment of a solenoid.
Figure 2B:
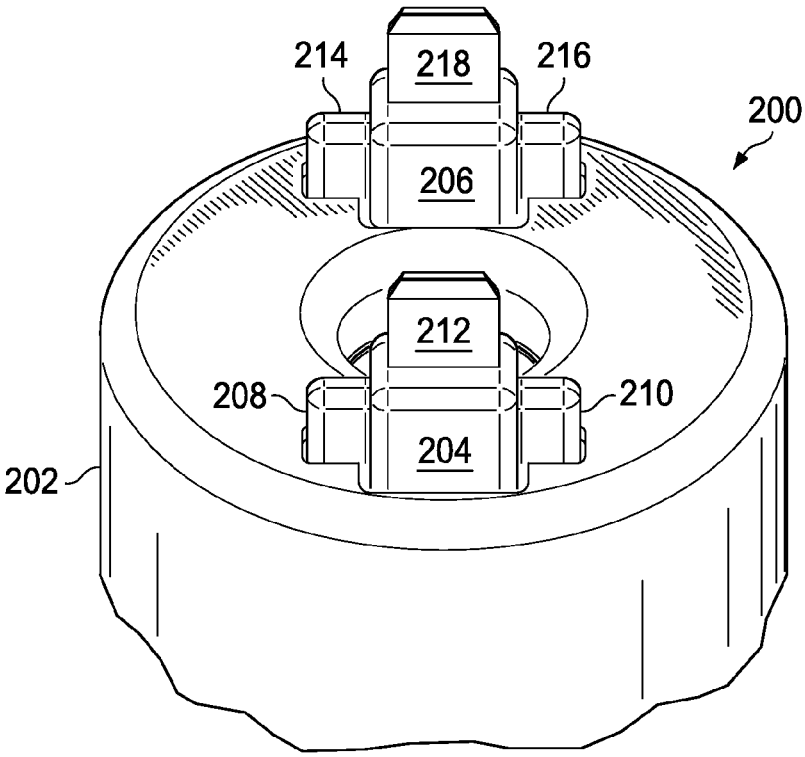
FIG. 2*b* is a perspective view illustrating an embodiment of the solenoid of FIG. 2*a*.

Referring now to FIGS. 2*a* and 2*b*, a solenoid 200 is illustrated. The solenoid 200 includes a cylindrical solenoid base 202 having a pair of terminal posts 204 and 206 extending from a surface of the solenoid base 202 in a spaced apart orientation on opposite sides of the surface of the solenoid base 202. The terminal post 204 includes a pair of terminal guides 208 and 210 that extend from the terminal post 204 in a substantially co-linear orientation on opposite sides of the terminal post 204, and a terminal 212 extending from a surface of the terminal post 204 and away from the solenoid base 202. The terminal post 206 includes a pair of terminal guides 214 and 216 that extend from the terminal post 206 in a substantially co-linear orientation on opposite sides of the terminal post 206, and a terminal 218 extending from a surface of the terminal post 206 and away from the solenoid base 202. In the illustrated embodiment, the terminal guides 208 and 210 are co-linear along a line that is parallel to and spaced apart from the line along which the terminal guides 214 and 216 are co-linear.

Figure 3A:
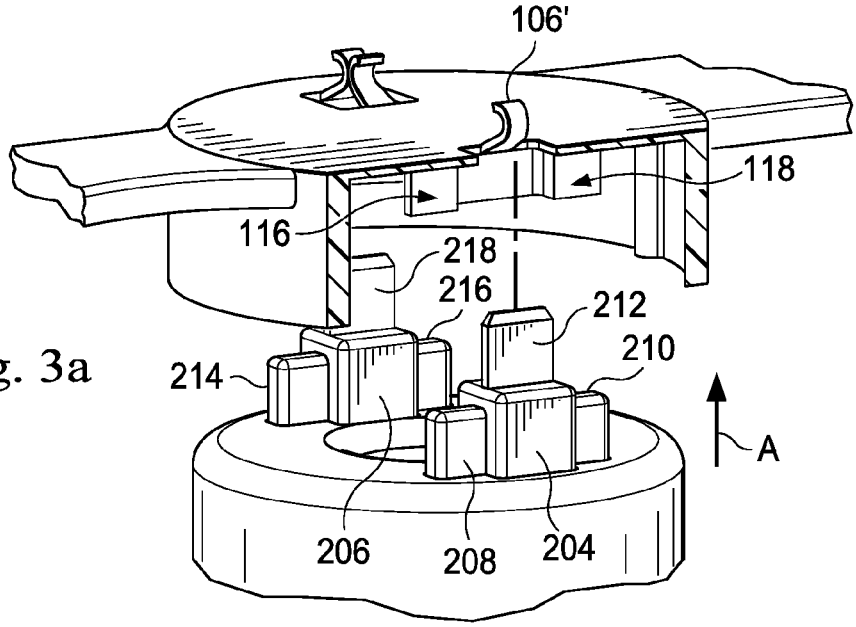
FIG. 3*a* is a cut-away perspective view illustrating an embodiment of the solenoid of FIGS. 2*a* and 2*b* being coupled to the lead frame of FIGS. 1*a* and 1*b*.

In order to make an electrical connection and coupling between the lead frame 100 and the solenoid 200, FIG. 3*a* illustrates the solenoid 200 adjacent the lead frame. Note that the lead frame 100, in FIG. 3*a* is inverted from the view of lead frame 100 in FIG. 1*a*, and that all of the features of lead frame 100 are not visible in FIG. 3*a*. Therefore, reference is made to FIGS. 1*a*, 2*a* and 3*a* for the following discussion.

With the lead frame 100 adjacent the solenoid 200, certain features are aligned. The terminal posts 204 and 206 are respectively aligned with locating and support members 114 and 108, respectively. As a result, terminals 212 and 218 are aligned with the slots 106, 104, respectively. The terminal guides 208 and 210 are aligned with the support channels 116, 118, respectively. The terminal guides 214 and 216 are aligned with the support channels 110, 112, respectively.

As a result of this alignment, movement of solenoid 200 in a direction designated by the directional arrow A, FIG. 3*a*, couples the solenoid 200 to the lead frame 100. When coupled, FIGS. 1*a*, 2*a*, 3*a* and 3*b*, the terminal posts 204 and 206 are in contact with the locating and support members 114 and 108, respectively. This results in the terminals 212 and 218 in electrical contact with the electrically conductive members 104' and 106' of the slots 106, 104, respectively. The terminal guides 208 and 210 are nested in contact with support channels 116, 118, respectively.

Figure 3B:
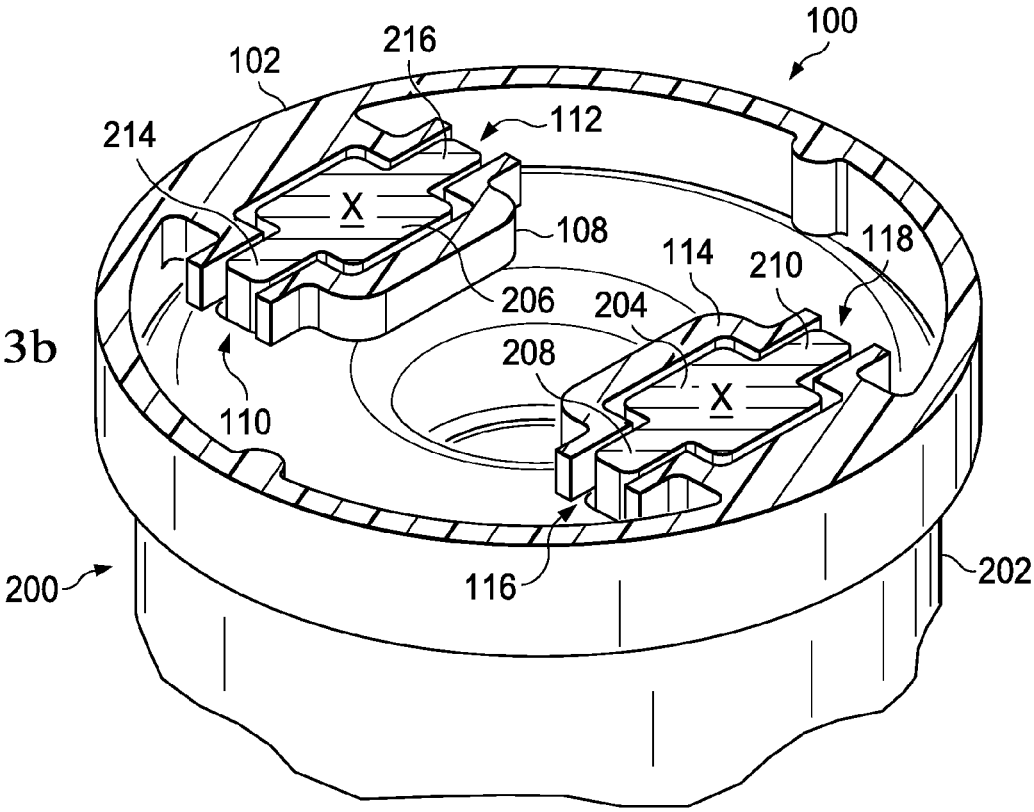
FIG. 3*b* is a cut-away perspective view illustrating an embodiment of the solenoid of FIGS. 2*a* and 2*b* coupled to the lead frame of FIGS. 1*a* and 1*b*.

Note that in FIG. 3*b*, the posts 204 and 206 are illustrated as cut-off at a surface designated x, to illustrate the alignment and seating of terminal posts 204, 206 with support members 114, 108, respectively.

In an embodiment, the dimensions of the pair of terminal guides 208 and 210 and the pair of locating and support channels 116 and 118, respectively, and the dimensions of the pair of terminal guides 214 and 216 and the pair of locating and support channels 110 and 112, respectively, are such that an interference fit is provided when the solenoid 200 is coupled to the lead frame 100. Thus, a coupling for a solenoid and lead frame is provided that includes features for locating and guiding a solenoid into coupling with a lead frame while providing a strong mechanical and electrical connection between the solenoid and lead frame that provides stability and resists decoupling.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A coupling comprising:

a lead frame including multiple pairs of projections, each pair of projections defining a pair of locating slots, a solenoid including multiple terminal posts, each terminal post including a pair of guides operable to engage a respective pair of the locating slots;

a pair of connectors on the lead frame, each connector being between a respective pair of the locating slots; and a pair of terminals on the solenoid, each terminal extending from a respective terminal post, each terminal being between a respective pair of the guides.

2. The coupling of claim 1 wherein each connector on the lead frame is located in a recess between the respective pair of locating slots.

3. The coupling of claim 2 wherein each guides extend a first distance from a surface of the solenoid and each post extends a second distance from the solenoid, greater than the first distance.

4. The coupling of claim 1 wherein a first pair of the locating slots on the lead frame are co-linear along a first line and a second pair of the locating slots on the lead frame are co-linear along a second line substantially parallel to the first line.

5. The coupling of claim 4 wherein a first pair of the guides on the solenoid are co-linear along the first line and a second pair of the guides in the solenoid are co-linear along the second line.

6. The coupling of claim 1 wherein the connectors on the lead frame comprise electrically conductive members operable to provide an electrical connection with the terminals on the solenoid.

7. A coupling system comprising:

a lead frame including multiple pairs of projections, each pair of projections defining a pair of aligned locating slots, and further comprising a respective connector located in a recess between each pair of locating slots; and a solenoid including multiple terminal posts, each terminal post including an aligned pair of guides operable to engage a respective pair of locating slots, and further comprising a respective terminal extending from each post and located between each pair of guides.

8. The system of claim 7 wherein the guides extend a first distance from the solenoid and each post extends a second distance from the solenoid, greater than the first distance.

9. The system of claim 7 wherein a first pair of the locating slots on the lead frame are co-linear along a first line and a second pair of the locating slots on the lead frame are co-linear along a second line substantially parallel to the first line.

10. The system of claim 9 wherein a first of the guides on the solenoid are co-linear along the first line and a second pair of the guides on the solenoid are co-linear along the second line.

11. The system of claim 7 wherein the connectors on the lead frame comprise electrically conductive members operable to provide an electrical connection with the terminals on the solenoid.

* * * * *